United States Patent [19]

Greenfield, Jr. et al.

[11] Patent Number: 4,474,198

[45] Date of Patent: Oct. 2, 1984

[54] FLATWARE PRE-CLEANER

[76] Inventors: Iriving E. Greenfield, Jr., 5331 SW. 92nd St., Miami, Fla. 33156; Paul H. Martin, 15630 SW. 103rd Pl., Miami, Fla. 33157

[21] Appl. No.: 416,071

[22] Filed: Sep. 8, 1982

[51] Int. Cl.[3] ..... B08B 3/02

[52] U.S. Cl. ..... 134/60; 134/154

[58] Field of Search ..... 134/60, 104, 100, 111, 134/135, 190, 198, 201, 154; 211/127, 113, 88

[56] References Cited

U.S. PATENT DOCUMENTS

| | | | |
|---|---|---|---|
| 1,045,079 | 11/1912 | Prunier et al. | 134/60 |
| 1,417,077 | 5/1922 | Langton et al. | 134/198 |
| 1,719,409 | 7/1929 | Webb | 134/60 |
| 2,635,614 | 4/1953 | Ford | 134/60 |
| 2,845,936 | 8/1958 | Boynton et al. | 134/60 |
| 3,243,318 | 3/1966 | Mihara et al. | 134/182 |
| 3,447,544 | 6/1969 | De Vergara | 134/111 |

*Primary Examiner*—Robert L. Bleutge
*Attorney, Agent, or Firm*—Harvey B. Jacobson

[57] ABSTRACT

A flatware pre-cleaner is disclosed which includes an elongated, inclined tray or tank divided into a plurality of open-topped compartments for receiving flatware. The tank is provided with water inlets and water outlets with a baffle provided at one inlet to distribute the water flow and a spray nozzle in the several compartments connected to the other inlet. The water outlets drain food particles therefrom and maintain a desired water level in the tank so that water discharged from the inlets agitates the water in which the food engaging ends of the flatware are immersed. The compartments are formed by screen partitions spaced above the bottom of the tank to enable gravity flow of food particles and the like to the outlet. Control valves, additive siphons and supporting structure are provided to render the pre-cleaner effective in pre-cleaning flatware.

10 Claims, 4 Drawing Figures

FLATWARE PRE-CLEANER

BACKGROUND OF THE INVENTION

1. Field of the Invention

The present invention relates to a flatware pre-cleaner for processing flatware and the like prior to cleaning and washing the flatware in a dish washing machine.

More particularly the invention is directed to a flatware pre-cleaner adapted to utilize water from a dish washing machine such as found in large kitchens in institutions such as hospitals, schools, cafeterias and the like where large numbers of people are fed.

The flatware pre-cleaner includes a tray, tank or container of elongated configuration forming a fluid path with a series of compartments formed by a set of dividers, each divider of the compartments having an opening at the bottom thereof for trash, garbage and the like to flow through. Further, each divider is perforated so water can flow through each compartment and thus equalize the water level. One discharge drain is set so as to have water at a consistent level so at least the eating or working end of the utensil or flatware is immersed or dipped and is subject thereby to soaking, and each compartment is designated for a selected and presorted flatware, whether knife, fork, or spoon with the water returning to the dish washing machine. A mounting structure provides support of the compartment from a wall and the compartment may be slightly inclined along its transverse dimension and tilted as well along its longitudinal dimension. Another discharge drain is provided at the lower bottom end for draining food particles, garbage or other waste material for discharge into an existing sewer or solid particles separated therefrom and the water returned to the dishwashing machine. One water inlet has a baffle at the intake end and another water inlet has a spray nozzle in each compartment to provide a desired water level and water agitation and movement for effectively pre-cleaning the flatware in the compartments.

The pre-cleaner for flatware may be mounted above the conveyor of any commercial dish machine or in any other convenient place such as over a scrape table. The pre-cleaner may be constructed of stainless steel and may be made so flateware is placed handle up in each compartment so that all flatware will be effectively pre-cleaned.

2. Description of the Prior Art

Various prior U.S. patents exemplary of the art are: U.S. Pat. Nos. 1,597,132 G. L. Wheelock; 2,567,820 E. A. Messerschmidt; 2,720,210 C. G. Lueck; 3,478,758 G. W. Davies; 4,146,404 S. R. H. Williams, Jr.

None of these patents discloses the combination of the specific details of the present invention is such a way as to bear upon the patentability of any claims of the present invention.

SUMMARY OF THE INVENTION

An object of the present invention is to provide a flatware pre-cleaner in which the flatware is maintained upright in an elongated tank or tray divided into compartments by partitions spaced from the bottom of the tank and perforated to enable water flow between compartments and gravity flow of food particles and the like under the partitions.

Another object of the present invention is to provide a flatware pre-cleaner in accordance with the preceding object in which water flow through the tank is maintained at a predetermined level with adjustable spray nozzles being provided in the compartments to agitate the water for effeciently pre-cleaning the flatware.

A further object of the invention is to provide a flatware pre-cleaner which will effectively pre-clean a large number of flatware items, can be installed in various locations in the kitchen, includes optional water inlets and additives supplied thereto by siphons, includes control valves for maintaining desired flow characteristics and reduces the time and labor required to effectively pre-clean flatware.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
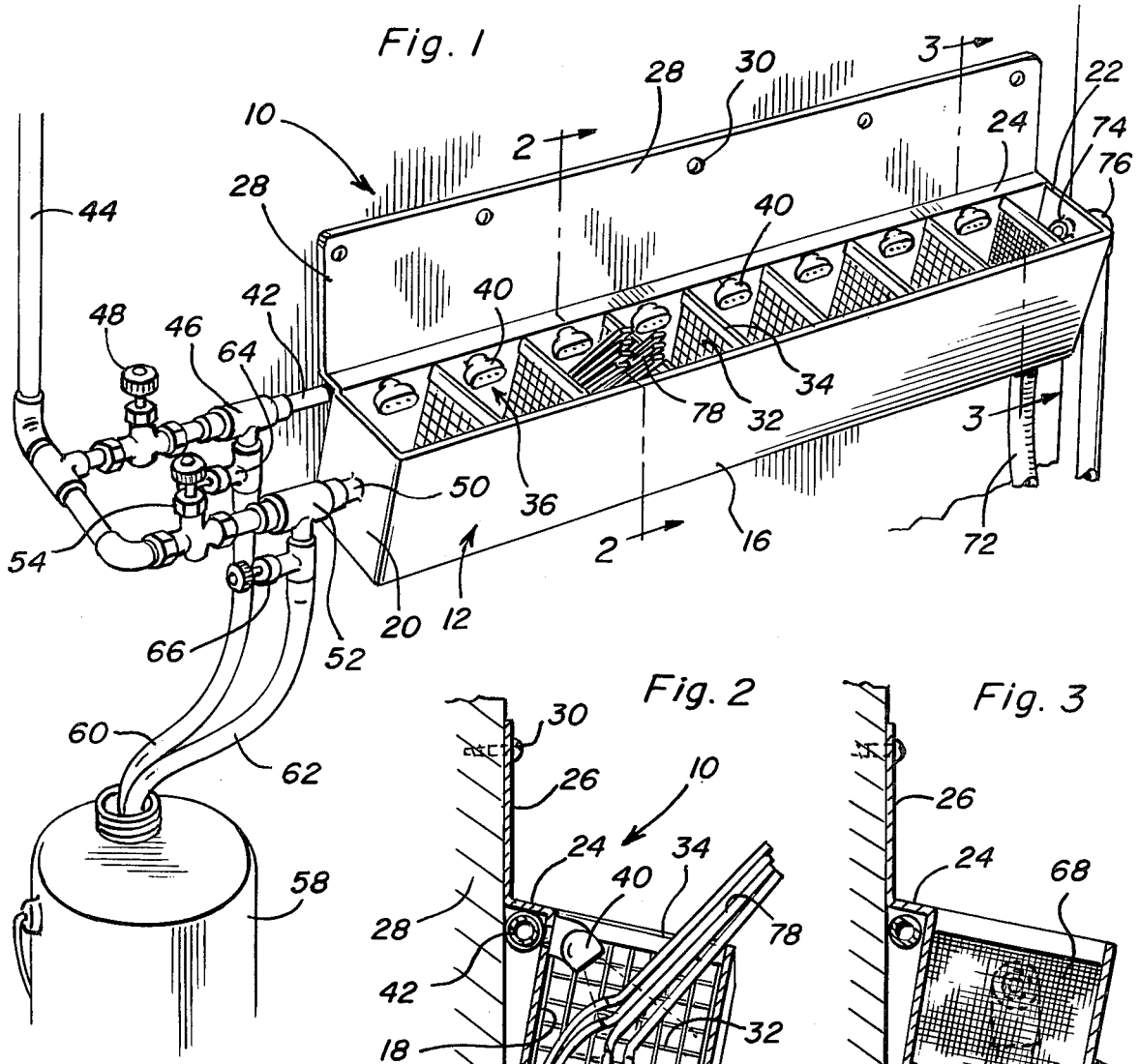
FIG. 1 is a perspective view of a flatware pre-cleaner apparatus according to the present invention.

Referring now to the drawings there is shown a flatware pre-cleaner apparatus 10 consisting of an elongated open top tank or tray 12 defined by a bottom wall 14, an upstanding front wall 16, rear wall 18 and end walls 20 and 22. The rear wall 18 has a rearwardly extending offset portion 24 and an upwardly extending support panel 26 supported from a vertical support surface 28 by fasteners 30. The offset portion 24 orients the tank or tray 12 in inclined or canted relation to the support panel 26 as shown in FIGS. 2 and 3.

Figure 4:
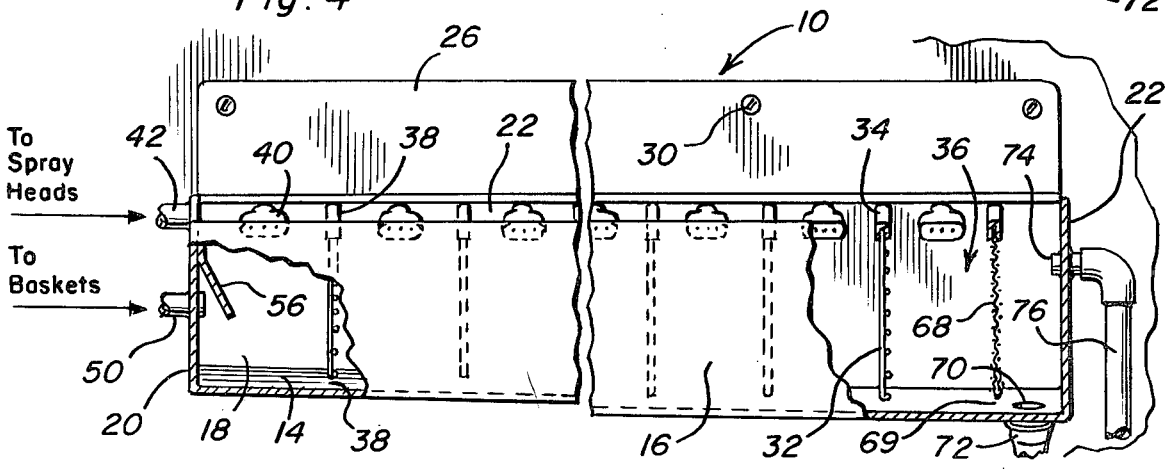
FIG. 4 is a fragmental front elevational view of the flatware pre-cleaner apparatus of the invention with portions broken away.

The tank 12 has a plurality of vertical partitions 32 of wire screen and a frame member 34 to define a plurality of compartments 36 with the lower edge of each partition 32 spaced a small distance above the bottom wall 14 to form a passwageway 38 between compartments. A water spary head 40 is provided in each compartment 36 except one of the end compartments and each spray head 40 is connected to a water inlet pipe 42 underlying the offset portion 24. One end of pipe 42 is coupled to a water supply pipe 44 from a dish washing machine through a siphon 46, and a valve member 48. The valve member 48 provides for adjustment of the fluid flow from the spray heads 40 into the compartments 36. A second water pipe 50 is connected to and extends through end wall 20 and is connected to the water supply pipe 44 through a siphon 52 and valve 54 for discharge of water into the end compartment 36 as shown in FIG. 4. A downwardly inclined baffle 56 is attached to end wall 20 and extends into spaced aligned relation to the discharge end of pipe 50 for deflecting incoming fluid downwardly. Each of the siphons 46, 52 have an inlet branch connected to a chemical additive tank 58 through inlet pipes or hoses 60, 62 and manually controlled valves 64, 66.

Figure 3:
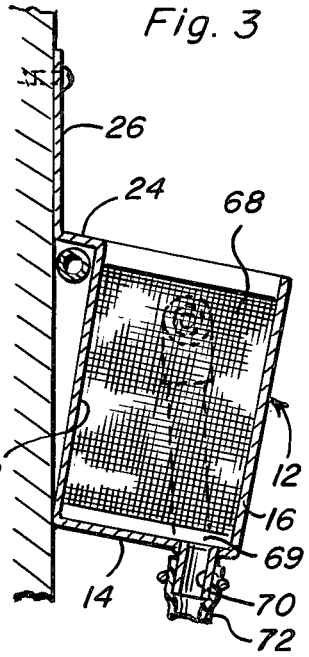
FIG. 3 is a sectional view taken along section line 3—3 of FIG. 1.

The compartment 36 at the end of the tank 12 remote from deflector 56 is slightly smaller and separted from the adjacent compartment by a small mesh screen wire baffle or partition 68 which is also spaced above the bottom wall 14 about ¼" as designated by numeral 69 in FIG. 3. This compartment is provided with a bottom drain 70 at the lower front thereof connected with a drain pipe or hose 72 and the end wall 22 includes a drain 74 adjacent its upper edge which is connected to a drain pipe or hose 76.

Figure 2:
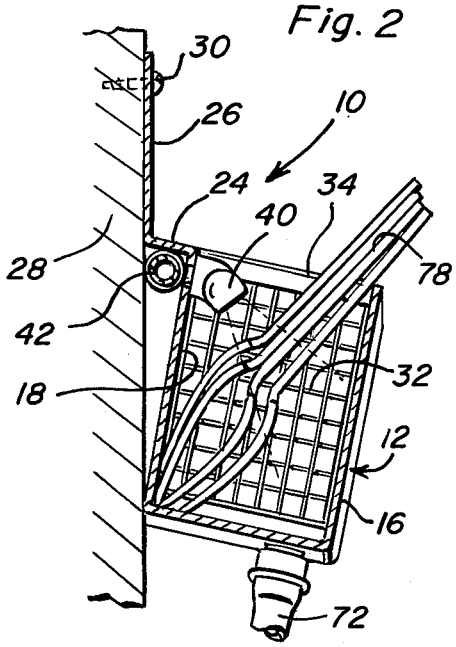
FIG. 2 is a sectional view taken along section line 2—2 of FIG. 1.

As illustrated, the pre-cleaner can be conveniently supported on a conventional commercial dishwasher or on any convenient vertical surface 28 above the dishwasher converyor (not shown) so that flatware 78 can be manually removed from the dishes without removing the dishes from the conveyor with the separated flatware 78 being placed in the compartments 36 with the food engaging end of the flatware being oriented downwardly and the flatware inclined upwardly and outwardly as illustrated in FIG. 2. This enables efficient placement of the flatware for most effective pre-cleaning and soaking and enables the flatware to be easily removed and placed back on the conveyor for movement into the dishwasher for final cleaning.

The spray nozzles 40 are conventional angularly adjustable nozzles connected to pipe 42 and the siphons, valves and other pipes and hoses are also conventional in and of themselves. The nozzles 40 are set to provide the most effective direction, force and type of water jet. Also, the two inlet pipes 42 and 50 can be used simultaneously or independently by using the valves which also control the water level in the tank and the velocity of the water. The siphons 46, 52 are conventional venturi structures and enable the addition of a selected quantity of cleaners, sterilizers, brighteners and the like as deemed necessary by the kitchen staff. This enables optional use of the additives thereby reducing or eliminating the cost thereof when not needed. This also will sometimes eliminate an extra trip of the flatware through the dish machine which is sometimes necessary for sterilization or brightening.

The dimensions of the compartments 36 are such as to hold the flatware 78 generally upright and prevents the flatware from falling to an inclined position of sufficient angle that the flatware could get caught under a partition which would present a problem since the water is too hot to retrieve items of flatware which become stuck in the space 38 by inserting one's hand into tank 12.

The water level in tank 12 is kept above the parts of the flatware 78 to be pre-cleaned and the spray nozzles may be adjusted to provide desired agitation for the best cleaning conditions in each compartment. The forwardly inclined tank and the slope toward the discharge end utilizes gravity to cause movement of solid particles of food, garbage and other waste material to the lower front corner area of the tank 12. The narrow end compartment 36 collects the food particles and other waste material which can be discharged from the large drain 70 either continuously or periodically and water collected in end compartment 36 may be discharged to a sewer or sent back to the dish machine after the food particles have been separated or removed. The drain 74 maintains a water level in the tank 12 and also may discharge back to the dish machine with a small motor and pump unit (not shown) being used for this purpose. The deflector 56 prevents upward splashing of very hot water and enables flatware to be placed in this compartment while the tank 12 is being filled with water.

While the pre-cleaner is effective when mounted on a dish machine, it can also be effectively used when attached to a scrape table or can be mobile to be located in an optimum location at different times or in different situations. Also, depending upon needs, two or more pre-cleaners may be used in the same kitchen and can be located end to end or in any desired orientation.

The pre-cleaner of this invention enables flatware to be properly cleaned by existing machines and will substantially eliminate the problem of dried food particles remaining on the flatware after it has been cleaned in a conventional dish machine. Water from the dish machine is used and hot water in motion, with optional additives, effectively pre-cleans the flatware and eliminates usual pre-soaking procedures which usually entails the placement of the flatware into a large receptacle having water and a cleaning agent therein and letting the flatware soak for predetermined time period thereby material reducing labor costs while providing a more effective pre-cleaning procedure.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A flatware cleaner comprising an elongated open-topped, compartment tank for receiving flatware in generally upright position, water inlet means communicated with said tank, water outlet means communicated with one end portion of said tank in spaced relation to the water inlet means, said tank compartments being formed by a plurality of parallel, perforate partitions spaced upwardly from the bottom of the tank to provide fluid flow between the compartments and to enable solid food particles and the like dislodged from the flatware to pass under the partitions and an outlet means for solid food particles and water adjacent the end portion of the tank having the water outlet means communicated therewith.

2. The invention as defined in claim 1 wherein said water inlet means and water outlet means are positioned to determine the water level in the tank.

3. The invention as defined in claim 2 wherein said tank is inclined for gravity flow of food particles to the lower end thereof, said food outlet means including a drain at the lower end of the tank, and said water outlet means including a drain disposed vertically above the food outlet means.

4. The invention as defined in claim 3 wherein said water inlet means includes a pipe extending longitudinally of the tank adjacent the top, and a plurality of spray nozzles communicated with the pipe and oriented in the compartments.

5. The invention as defined in claim 4 wherein said water inlet means includes an inlet pipe communicating with the end compartment remote from the water outlet means through an end wall of the tank, and an inclined imperforate baffle overlying the end of the inlet pipe extending into the end compartment.

6. The invention as defined in claim 5 wherein each of said pipes forming the water inlet means includes valve means and siphon means to selectively control water flow to the spray nozzles and against the baffle and selectively control the flow of additive material into the tank with the water through the nozzles or into the end compartment.

7. In combination with a dish washing machine having a pressurized water source, a flatware pre-cleaner having a water inlet means communicated with the water source and a water outlet means communicated with the dish washing machine, said pre-cleaner comprising a receptacle for receiving flatware items oriented generally in upright position with the food engaging portions thereof positioned downwardly for contact by water passing from the inlet means to the outlet means, said receptacle being an elongated, open-topped, multicompartmented, inclined tank having mesh type partitions spaced from the bottom of the tank for flow of water through the partitions and movement of food particles under the partitions and a drain in the bottom of the tank below the water outlet means to remove solid food particles from the tank, said water outlet means being positioned above the bottom of the tank to determine the water level in the tank.

8. The invention as defined in claim 7 wherein said tank has a bottom inclined in two generally horizontal planes, said water outlet means being spaced above the tank bottom to maintain a predetermined level in the tank, said drain being located adjacent the lowest point of the bottom of the tank.

9. The invention as defined in claim 8 wherein said water inlet means includes a pipe extending along the top of the compartments at the highest point in each compartment, said pipe including a spray nozzle directing water spray downwardly into each compartment, said portion of the pipe extending over the end compartment having the water outlet means and drain therein being solid and not provided with a spray nozzle, said water inlet means also including a pipe extending into the end compartment remote from the compartment having the water outlet means therein with this pipe being disposed below the spray nozzles, a downwardly and inwardly inclined baffle extending transversely of the end of the inlet pipe to deflect water downwardly into the end compartment, each of said pipes including a valve for selectively controlling flow of water through the spray nozzles and into the end compartment, each of said pipes including a venturi communicated with an additive material to enable selective addition of material to the water in the tank through the spray nozzles and into the end compartment, the end compartment adjacent the end of the tank having the water outlet means therein being defined by a partition of mesh-type material having openings smaller than the mesh-type material forming the other partitions to assure flow of solid food particles under the partition having smaller openings in the mesh-type material for discharge of such particles through the drain rather than through the water outlet means back into the dishwasher.

10. The invention as defined in claim 6 wherein said tank includes a bottom inclined in two generally horizontal planes with the food outlet means located adjacent the lowest point on the bottom for discharge of solid food particles and the like therefrom, the partition defining the compartment having the water outlet means and the solid food outlet means communicated therewith having perforations of smaller cross-sectional dimensions than the perforations in the other partitions to assure flow of solid food particles under the partition with the smaller perforations therein for assuring discharge of food particles through the food particle outlet means.

* * * * *